US007150055B2

(12) United States Patent
Wootten, Jr.

(10) Patent No.: US 7,150,055 B2
(45) Date of Patent: Dec. 19, 2006

(54) MULTI-LAYERED BEDCLOTHES MATERIAL

(75) Inventor: Gerald E. Wootten, Jr., Cullman, AL (US)

(73) Assignee: HomTex Inc., Vinemont, AL (US)

( * ) Notice: Subject to any disclaimer, the term of this patent is extended or adjusted under 35 U.S.C. 154(b) by 0 days.

(21) Appl. No.: 10/395,875

(22) Filed: Mar. 25, 2003

(65) Prior Publication Data

US 2004/0187211 A1 Sep. 30, 2004

(51) Int. Cl.
*A47G 9/02* (2006.01)

(52) U.S. Cl. ..... 5/502; 5/482; 112/420

(58) Field of Classification Search ..... 5/482, 5/502, 500; 428/102; 112/401, 402, 420
See application file for complete search history.

(56) References Cited

U.S. PATENT DOCUMENTS 365,625 A * 6/1887 Palmer ..... 5/502
3,081,517 A * 3/1963 Driesch ..... 428/91
3,541,620 A * 11/1970 Chapuis ..... 5/413 R
3,649,428 A * 3/1972 Hughes ..... 428/91
3,801,420 A * 4/1974 Anderson ..... 428/102
4,962,554 A * 10/1990 Tesch ..... 5/502
5,150,660 A * 9/1992 Kuczynski ..... 112/402
5,217,780 A * 6/1993 Wurzer ..... 428/74
5,283,111 A * 2/1994 Schlecker ..... 442/31
5,855,032 A * 1/1999 Field ..... 5/502
6,174,584 B1 * 1/2001 Keller et al. ..... 428/102
6,618,881 B1 * 9/2003 Hart et al. ..... 5/502
6,696,128 B1 * 2/2004 McIntee et al. ..... 428/102

* cited by examiner

*Primary Examiner*—Michael Trettel
(74) *Attorney, Agent, or Firm*—Dykema Gossett PLLC

(57) ABSTRACT

A material for bedclothes includes first and second outer layers connected together at their peripheries, the first outer layer being made of at least two sub-layers connected together, one sub-layer being a smooth fabric material and a second sub-layer being made of a comfort-adjusting material such as a heat insulating material (fibrous batting). The second outer layer is made of a smooth fabric material (cotton sheeting). The first and second sub-layers can be sewn together to provide a quilted, non-smooth outer surface. The smooth outer layer is intended for contact with a person using the bedclothes.

15 Claims, 3 Drawing Sheets

MULTI-LAYERED BEDCLOTHES MATERIAL

BACKGROUND OF THE INVENTION

1. Field of the Invention

The present invention relates to bedclothes such as bed sheets, blankets and comforters, and in particular to materials which can be used to make such bedclothes.

2. The Prior Art

Materials used to fabricate bedclothes such as bed sheets, blankets and comforters are well known and include cotton fabrics, satin, linen, polymer and polymer blend fabrics, wool fabrics, down-filled composite materials, etc. However, none of the known materials include a comfort-adjusting material, such as an insulation material, which also provides a smooth surface facing the person using the product.

I have developed such a material.

SUMMARY OF THE INVENTION

According to my invention, a multi-layered bedclothes material includes a first outer layer which includes a comfort-adjusting material and a second outer layer which is made of a smooth fabric, these two outer layers being attached at their peripheries so as to form a bedclothes item such as a flat bedsheet, a fitted bedsheet, a blanket, a comforter, etc. A comfort-adjusting material is a heat-insulating material, a moisture wicking material, or a heat reflecting material. The first outer layer is itself preferably formed of a first (outer) sub-layer that is made of a smooth fabric material and a second (inner) sub-layer that is made of a batting (heat insulating) material, the first and second sub-layers being connected together (e.g. stitched) to provide an outer surface for the bedclothes material which is not smooth (e.g. quilted). The first outer layer can also include a third inner sub-layer of a smooth fabric, with the second batting sub-layer being connected (e.g. stitched) between the first and third smooth fabric sub-layers. The inventive bedclothes material can be used to form flat or fitted bed sheets, blankets, comforters, etc.

The invention will now be better understood by reference to the attached drawings, taken in conjunction with the following discussion.

DETAILED DESCRIPTION OF THE PREFERRED EMBODIMENTS

Figure 1:
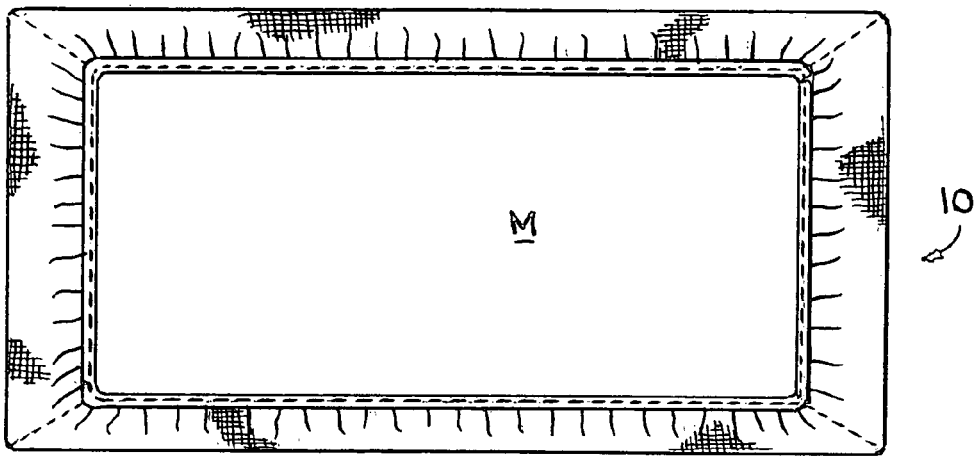
FIG. 1 is a bottom view of a fitted bed sheet made of a multi-layered bedclothes material according to a preferred embodiment of the invention, the fitted bed sheet being depicted on a mattress.
Figure 2:
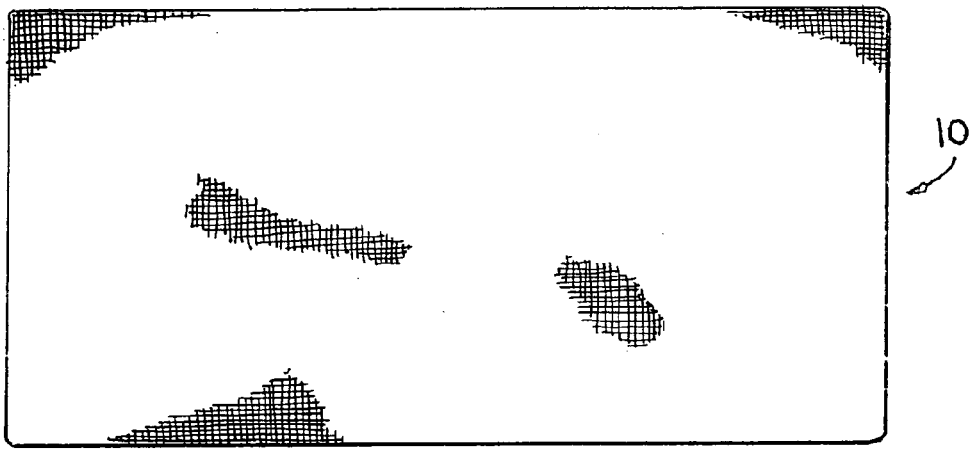
FIG. 2 is a top view of the fitted bed sheet shown in FIG. 1.
Figure 3:
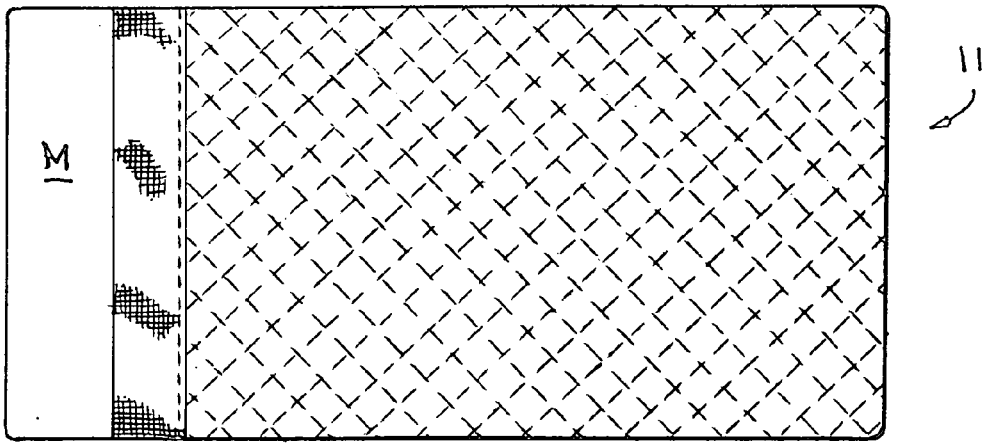
FIG. 3 is a top view of a flat bed sheet made of a multi-layered bedclothes material according to a preferred embodiment of the invention, the flat bed sheet being depicted on a mattress.

The multi-layered bedclothes material of the present invention can be fabricated into a fitted bed sheet 10 that is mounted on a mattress M in a conventional manner as shown in FIGS. 1 and 2, or it can be fabricated into a flat bed sheet 11 as shown in FIG. 3. The multi-layered bedclothes material can also be fabricated into other products used with bedding, such as comforters or blankets.

Figure 4:
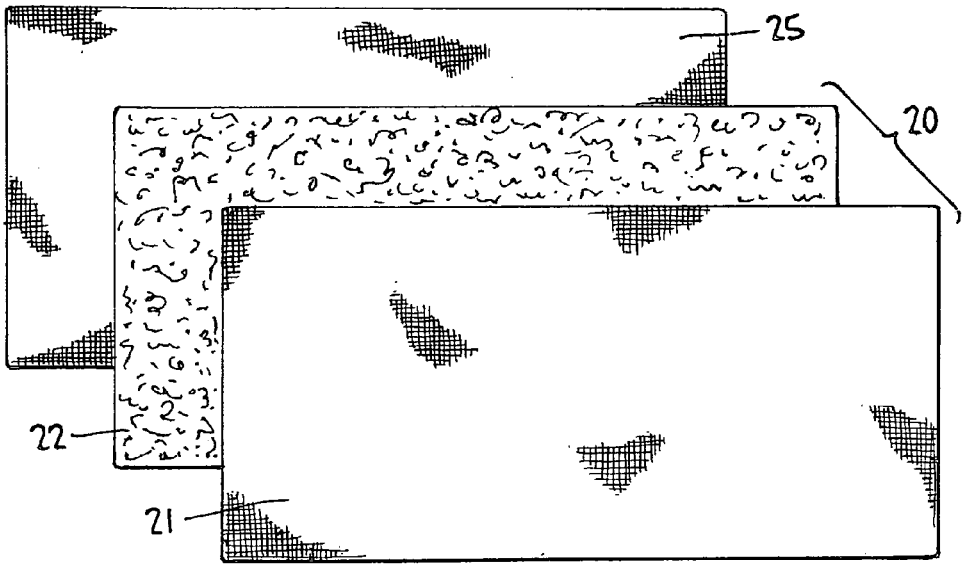
FIG. 4 is an exploded view of a first embodiment of bedclothes material according to the invention prior to attachment of its layers together.
Figure 5:
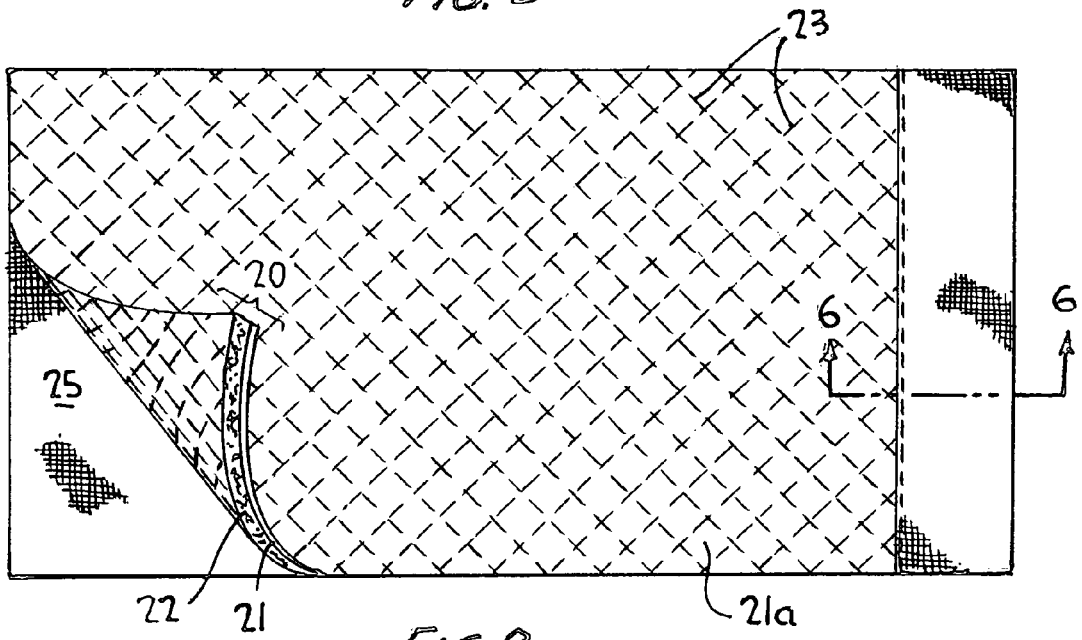
FIG. 5 is a view of the bedclothes material of FIG. 4 after attachment of its layers and in the form of a flat bed sheet.
Figure 6:
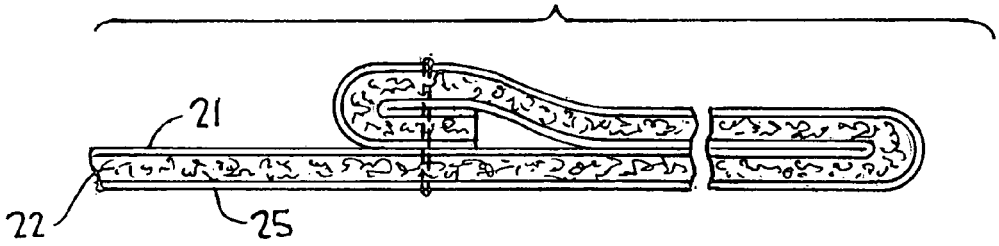
FIG. 6 is a view of FIG. 5 as seen along line 6—6.

The multi-layered bedclothes material of the invention includes a first comfort-adjusting outer layer and a second smooth outer layer attached (stitched together) at their peripheries. One preferred embodiment is represented in FIGS. 4, 5 and 6. This embodiment includes a first outer layer 20 and a second outer layer 25. The first outer layer 20 is formed of a first outer sub-layer 21 and a second inner sub-layer 22 sewn together in a crisscross fashion 23 to form a quilted (non-smooth) outer surface 21*a* (see FIG. 5). The first outer sub-layer 21 is made of a smooth cotton or a polycotton cloth fabric and the second inner sub-layer 22 is made of a polyester or polyester/acrylic blend fiberfill fabric. The second outer layer 25 is formed of cotton sheeting. The second outer layer 25 is intended for contact with the person laying in a bed whereas the first outer layer in this embodiment provides insulation and warmth.

Figure 7:
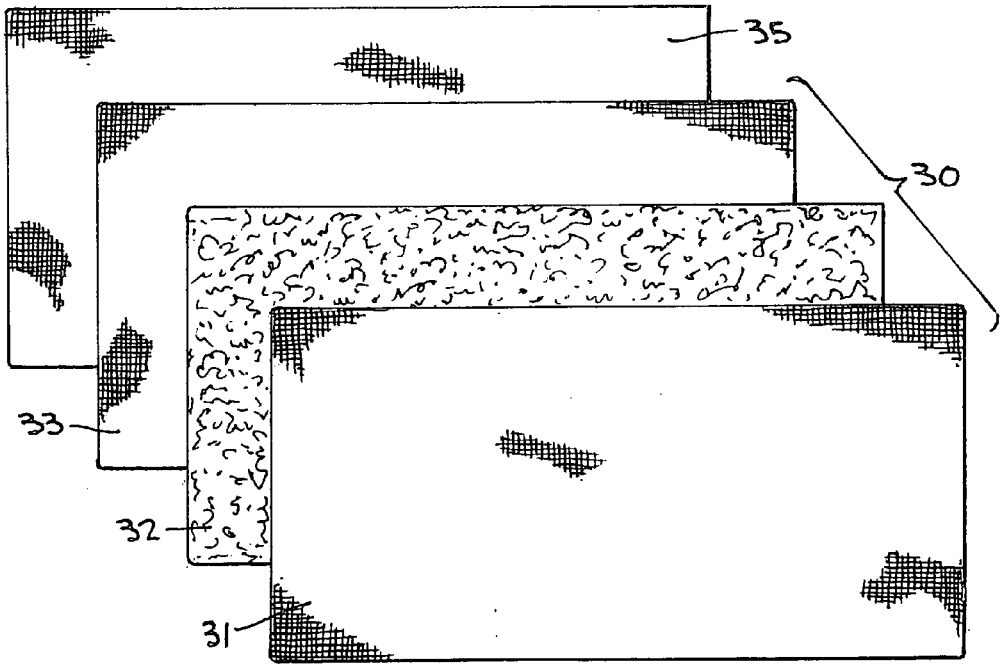
FIG. 7 is an exploded view of a second embodiment of bedclothes material according to the invention prior to attachment of its layers together.
Figure 8:
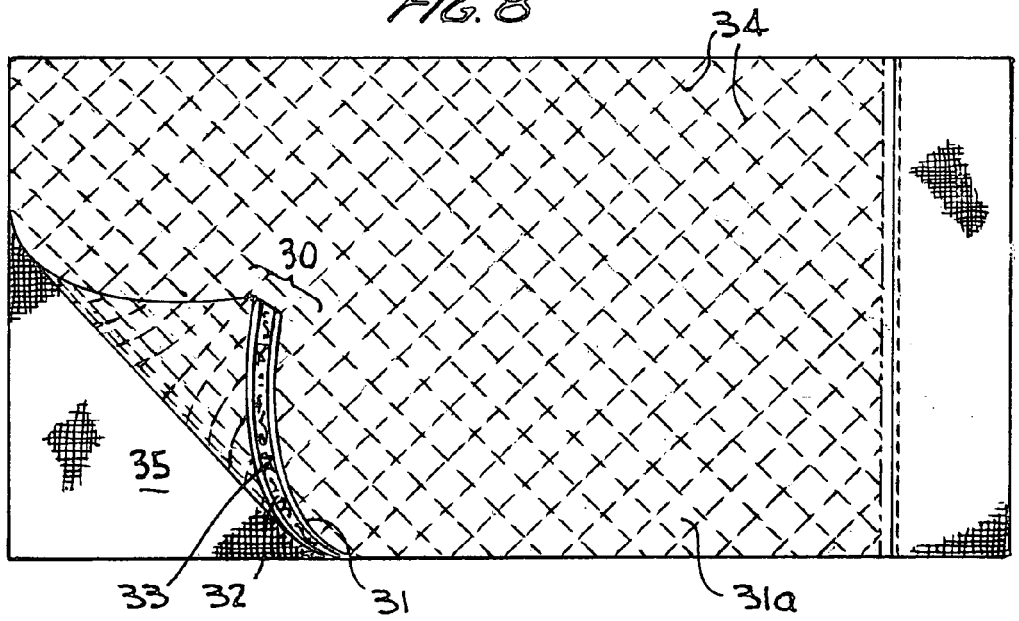
FIG. 8 is a view of the bedclothes material of FIG. 7 after attachment of its layers and in the form of a flat bed sheet.

Another preferred embodiment of the inventive multi-layered bedclothes material is represented in FIGS. 7 and 8. This embodiment includes a first outer layer 30 and a second outer layer 35. The first outer layer 30 is formed of a first outer sub-layer 31, a second inner sub-layer 32 and a third inner sub-layer 33, these sub-layers being sewn together with crisscross stitching 34 to form a quilted outer surface 31*a* (see FIG. 8). The first outer sub-layer 31 is made of a smooth cotton or a polycotton cloth fabric, the second sub-layer 32 is made of a polyester or polyester/acrylic blend fiberfill fabric, and the third sublayer 33 is made of a poly or polycotton sheeting fabric. The second outer layer 35 is formed of cotton sheeting and is intended for direct contact by the person lying in a bed. The first outer layer 30 in this embodiment provides insulation and warmth. The additional sub-layer 33 in this embodiment prevents bunching of the sub-layer 32 during the sewing process.

It should be understood that the first outer layer of the multi-layered bedclothes material of the invention need not be constructed as shown in FIGS. 4–8 but can include a down-filled layered fabric material. The second sub-layer of the first outer layer can be made of a material which wicks moisture away from a person in the bed, or a heat-reflecting (cooling) material.

I claim:

1. A multi-layered bedclothes material which comprises first and second outer layers, said first outer layer comprising a first outer sub-layer attached to a second inner sub-layer, said first outer sub-layer consisting of a cotton fabric and said second inner sub-layer being made of a comfort-adjusting material, said first and second sub-layers being connected by crisscross stitching so as to become quilted, and said second outer layer consisting of a smooth cotton fabric, said first and second outer layers being attached together along each of their peripheries but not connected by said crisscross stitching.

2. The multi-layered bedclothes material of claim 1, wherein said comfort-adjusting material is fiberfill batting.

3. The multi-layered bedclothes material of claim 2, wherein said fiberfill batting comprises polyester or polyester/acrylic blend fibers.

4. The multi-layered bedclothes material of claim 1, wherein said comfort-adjusting material is a wicking material.

5. The multi-layered bedclothes material of claim 1, wherein said comfort-adjusting material is a heat-reflecting material.

6. The multi-layered bedclothes material of claim 1, wherein said first outer layer includes a third inner sub-layer, said second inner sub-layer being located between said first outer sub-layer and said third inner sub-layer, said third inner sub-layer being a fabric material, said crisscross stitching connecting said first, second and third sub-layers to become quilted.

7. A flat bedsheet formed of a multi-layered bedclothes material as defined in claim 1.

8. A fitted bedsheet of a multi-layered bedclothes material as defined in claim 1.

9. The multi-layered bedclothes material of claim 1, wherein said first outer sub-layer is composed of polycotton cloth fabric.

10. A multi-layered bedclothes material which consists of first and second outer layers, said first outer layer consisting of a first outer sub-layer attached to a second inner sub-layer, said first outer sub-layer consisting of a cotton fabric and said second inner sub-layer being made of a comfort-adjusting material, said first and second sub-layers being connected by crisscross stitching so as to become quilted, and said second outer layer consisting of a smooth cotton fabric, said first and second outer layers being attached together at their peripheries but not connected by said crisscross stitching.

11. The multi-layered bedclothes material of claim 10, wherein said comfort-adjusting material is fiberfill batting.

12. The multi-layered bedclothes material of claim 10, wherein said fiberfill batting comprises polyester or polyester/acrylic blend fibers.

13. The multi-layered bedclothes material of claim 10, wherein said comfort-adjusting material is a wicking material.

14. The multi-layered bedclothes material of claim 10, wherein said first outer sub-layer is composed of polycotton cloth fabric.

15. A multi-layered bedclothes material which consists of first and second outer layers, said first outer layer consisting of a first outer sub-layer, a second inner sub-layer and a third inner sub-layer therebetween, said first outer sub-layer consisting of a cotton fabric, said second inner sub-layer being made of a comfort-adjusting material and said third inner sub-layer being a fabric material, said first, second and third sub-layers being connected by crisscross stitching so as to become quilted, and said second outer layer consisting of a smooth cotton fabric, said first and second outer layers being attached together at their peripheries but not connected by said crisscross stitching.

* * * * *